US005460245A

United States Patent [19]

Bittar

[11] Patent Number: 5,460,245

[45] Date of Patent: Oct. 24, 1995

[54] ELEVATOR SWING CAR SERVICE OF INTERRISE HALL CALLS

[75] Inventor: Joseph Bittar, Avon, Conn.

[73] Assignee: Otis Elevator Company, Farmington, Conn.

[21] Appl. No.: 179,169

[22] Filed: Jan. 10, 1994

Related U.S. Application Data

[63] Continuation-in-part of Ser. No. 887,946, May 26, 1992, Pat. No. 5,300,739.

[51] Int. Cl.[6] ..... B66B 1/18

[52] U.S. Cl. ..... 187/383; 187/387

[58] Field of Search ..... 187/380, 384, 187/383, 387, 901

[56] References Cited

U.S. PATENT DOCUMENTS

| | | | |
|---|---|---|---|
| 4,298,100 | 11/1981 | Süss et al. | 187/29 R |
| 4,431,085 | 2/1984 | MacDonald | 187/29 R |
| 4,662,480 | 5/1987 | Polis et al. | 187/126 |
| 4,792,019 | 12/1988 | Bittar et al. | 187/125 |
| 5,092,430 | 3/1992 | Goto et al. | 187/122 |
| 5,272,287 | 12/1993 | Meguerdichian et al. | 187/100 |
| 5,300,739 | 4/1994 | Bittar | 187/127 |

FOREIGN PATENT DOCUMENTS

| | | | |
|---|---|---|---|
| 1231793 | 12/1989 | Japan . | |
| 4-80185 | 3/1992 | Japan | 187/383 |

OTHER PUBLICATIONS

Abstract of Published Japanese Patent Application %4–209179, Jul. 30, 1992, Hirashiki.

*Primary Examiner*—Peter S. Wong
*Assistant Examiner*—Robert Nappi

[57] ABSTRACT

In an elevator system having a low rise group of floors and a high rise group of floors and a swing car having doors and car call buttons that enable it to operate in both the low rise group of floors and the high rise group of floors, interise hall calls made within one of said group of floors for service within another of said group of floors are assigned to the swing car for response. In one embodiment, the call is assigned to the first car approaching the call in the right direction; in another embodiment, the call is assigned in accordance with ordinary hall call assignment logic.

15 Claims, 5 Drawing Sheets

ELEVATOR SWING CAR SERVICE OF INTERRISE HALL CALLS

This application is a continuation-in-part of parent application U.S. Ser. No. 07/887,946 filed May 26, 1992, now U.S. Pat. No. 5,300,739.

TECHNICAL FIELD

This invention relates to use of elevator swing cars to answer hall calls in one rise of a building (low or high) which require service to another rise of a building (high or low).

BACKGROUND ART

There is a half century of history of schemes which have been implemented for improving the efficiency of elevators. Among these are ways of determining which car shall answer a hall call, such as the relative system response dispatchers disclosed in U.S. Pat. Nos. 4,363,381, 4,815,568, to Bittar, and 5,024,295. Others involve peak period dispatching, including zoning and channeling, some of which is disclosed in U.S. Pat. Nos. 4,792,019 and 4,838,384. And, to improve further on such systems, various forms of traffic prediction estimates have been used, such as in U.S. Pat. No. 5,022,497. The systems become more sophisticated with techniques which have been variously referred to as artificial intelligence, fuzzy logic and so forth. All of the foregoing relate to efficient operation of the elevators within a group.

To achieve more efficient operation of tall buildings (in excess of, say, 20 floors) buildings have been provided with groups of elevators, one group operable only to the lowermost floors, and the other group operable only in the highest floors of the building, in which case the groups are referred to as the "low rise" and the "high rise". And, there may be buildings with more than two rises.

In the aforementioned parent application, swing cars that can serve a low rise and a high rise (or low and medium, medium and high) are selectively assigned to the group controller related to that rise (low or high) having the highest traffic burden, on an every cycle basis with the possibility, and real likelihood, of assigning each swing car to a different group each time that it completes a trip. That system takes advantage of the precept that regardless of the floors at which persons enter an elevator, they are not concerned with which lobby service corridor they are delivered to, and therefore can be delivered to the lobby service corridor of a group other than the group under the control of which the passengers entered the car at floors above the lobby. In that system, elevator cars which are located within the lobby service corridor dedicated solely to one group (e.g., low rise) are also located in the lobby service corridor dedicated solely to a second group (e.g., high rise). Such an elevator swing car has doors on two sides operable to allow passage of passengers between the car and either one of two such distinct lobby service corridors which are opened to the lobby service corridor associated with the set of floors to which it has been assigned for its next run as it approaches the lobby floor at the conclusion of a current run, without regard to the set of floors to which it had been assigned during the current run. In normal operation, each swing car is assigned to a group controller related to one set of floors each time that the swing car concludes a run and approaches the lobby floor. In any cycle when an elevator is being assigned, it can be assigned to one of the groups and help that group out. Within minutes, either itself or a companion swing car can be assigned to the other group to help that group out. Within minutes it can be reassigned to the second group or it can be assigned back to the first group, the point being that no fancy determination has to be made because the determination can be reversed on a cyclic, per-run basis. Once an elevator is assigned to a group, it simply is added into the software for that group and can be handled in the same fashion as any other elevator in that group.

In the tallest buildings, there is no doubt but that the use of a high rise, having an express run to the lowest one of the floors in the high rise, facilitates movement of passengers to the higher floors. However, the ability to maximize tenant utilization and therefore building revenues is hampered by the fact that persons in the high rise cannot reach the low rise except by way of the lobby, and vice versa. This makes it difficult for tenants in one of the rises to expand by utilizing available space in the other rise. A partial alleviation of this situation is achieved by having an overlap floor, which may be near the top of a low rise or near the bottom of a high rise, where passengers can gain access to both rises. In such a case, however, the passenger usually has to transfer from one corridor to another corridor and wait for a second elevator in order to reach other than the overlap floor.

DISCLOSURE OF INVENTION

Objects of the invention include providing interrise service in an elevator system having high rise floors and low rise floors served by different elevator groups and having at least one swing car which may be utilized in either the low rise group or the high rise group.

According to the present invention, a swing car having two sets of doors, one of which provides access to low rise corridors and the other of which provides access to high rise corridors is allowed to accept hall call assignments in one rise which will require service to another rise. According further to the invention, the interrise calls may be handled simultaneously with assignment in either the low rise group or the high rise group.

In one embodiment of the invention, a swing car may be assigned to a group in addition to the high rise group and the low rise group, such as an interrise group which merely handles hall calls made in one rise that will result in car calls for service to floors located in the other rise. In another embodiment of the invention, an interrise call is assigned to the first elevator examined which is operable in both the high rise and the low rise, and is ahead of the call even though it is assigned to either the high rise group controller or the low rise group controller.

In further accord with the invention, the hall calls entered by a passenger boarding in response to an interrise hall call may be limited to companion security floors.

The exemplary embodiments herein are illustrative of controls which can utilize the precepts of the invention to provide interrise traffic with swing cars between a lower rise and a higher rise.

The present invention is implementable using nothing but apparatus and software techniques which are well known in the art, in the light of the teachings hereinafter.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
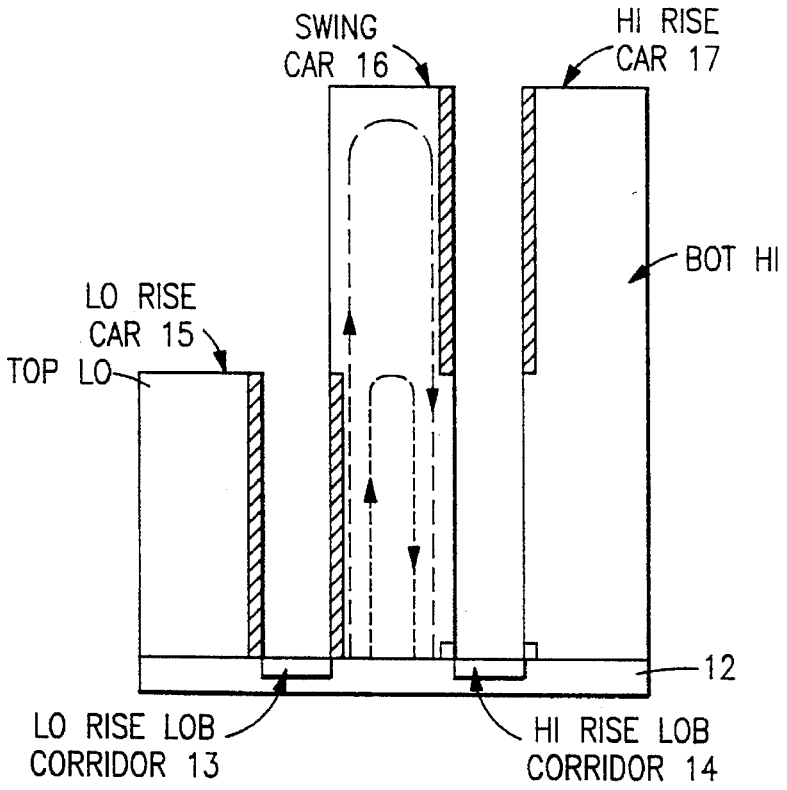
FIG. 1 is a simplified, stylized sectioned side view of an elevator system employing the present invention.

Referring now to FIG. 1, the lobby floor of a building having an elevator system incorporating an embodiment of the present invention has a general lobby area 12 which feeds into two corridors 13, 14 designated as low rise (LO) and high rise (HI). As illustrated, the low rise lobby corridor 13 will serve a designated low rise car 15 and the low rise portion of a swing car 16 (as shown by the dotted arrow in FIG. 1). The high rise lobby corridor 14 will serve a dedicated high rise car 17 and the high rise service of the swing car 16 (as shown by the dashed arrow in FIG. 1). In fact, a typical installation will more likely have two through six low rise cars, and a similar number of swing cars and high rise cars. The system of the aforementioned parent assigns the swing car 16 to serve either the low rise or the high rise; thereafter, when it completes service in the assigned rise, the swing car 16 must return to the lobby to be assigned again either to the same or to the other rise; when serving the high rise floors, the low rise floors fall within its express zone (which is the case all of the time for the high rise car 17). In accordance with a multi-group embodiment of the invention, an interrise hall call can be assigned to a swing car even though that swing car is already assigned to the high rise group or the low rise group, and without regard to whether the interrise call is registered in the high rise or the low rise. In this embodiment of the invention, any swing car which is available to both the high rise and the low rise at a given moment becomes a candidate for assignment of the call in the usual fashion, such as utilizing the relative system response principles of the aforementioned Bittar '381 patent. The assignment of interrise hall calls to an elevator which is basically assigned to the low rise group or the high rise group is shown in a commonly owned, co-pending U.S. patent application filed contemporaneously herewith, Ser. No. 08/179,459. A system having a swing car, of the type illustrated in FIG. 1, includes an interrise hall call button, perhaps requiring a key, key card or keypad for entry, to request service for travel into the high rise, and similarly for travel from the high rise to the low rise. In a first embodiment, the present invention is accommodated simply by defining interrise as a group and allowing interrise group hall calls to be assigned to a swing car even when it is assigned to the low rise group or to the high rise group.

Much of the disclosure herein is the same as and somewhat modified from the disclosure in the aforementioned parent and contemporaneous application. To facilitate amplifying the disclosure that is contained herein, the same reference numerals are used herein as are used for identical things in the parent and in the contemporaneous application; similar items bear the same numbers with letter suffixes to indicate the similarity to the parent but with modification.

The traffic burden values for the high rise and for the low rise calculated as described with respect to FIG. 11 of the aforementioned parent are utilized for a building low/high software module to determine which rise should have the next swing car assigned to it. The process simply determines if low burden is equal to or greater than high burden, and if so, sets a flag (used in FIG. 2) indicating that the low rise should be assigned the next available swing car; otherwise, the flag is not set. In the example shown in FIG. 11 of the parent, the ability to bias the burdens before making the determination is provided, as an option which is not necessary to the invention. The actual determination takes place in a test which simply determines if low burden is equal to or greater than high burden. If it is, an affirmative result sets a "next equal low" flag; if low burden is not equal to or greater than high burden, then a negative result of that test reaches a step which resets the "next equal low" flag, thereby causing the next car to be assigned to the high rise. Thus the building determination of low or high for the next assignment of a swing car is simply comparing traffic burdens and either setting or resetting "next equal low".

Figure 2A:
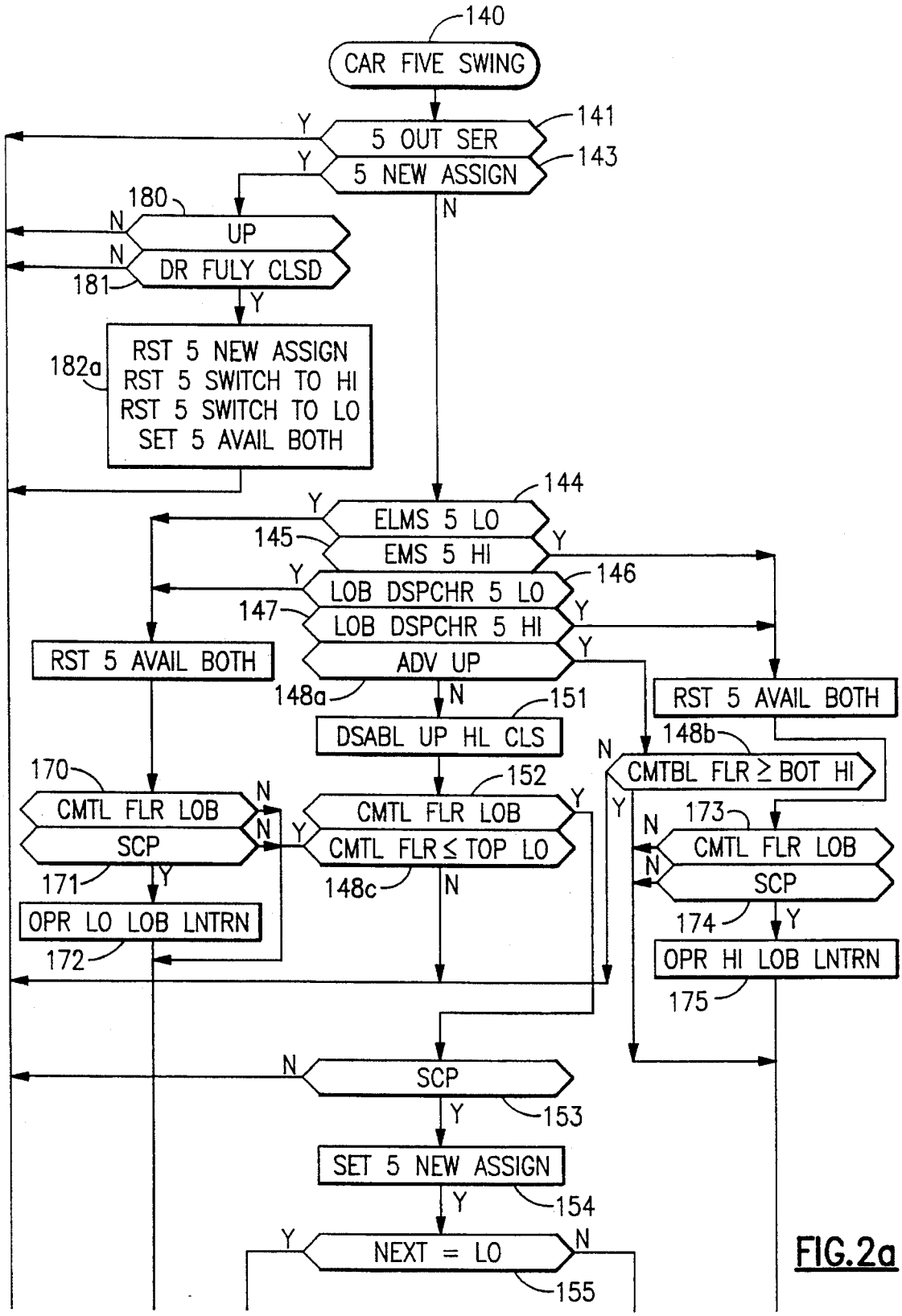
FIG. 2 is a logic flow diagram of an exemplary routine for performing the functions necessary to operate car five in either the low group or the medium group, or both.
Figure 2B:
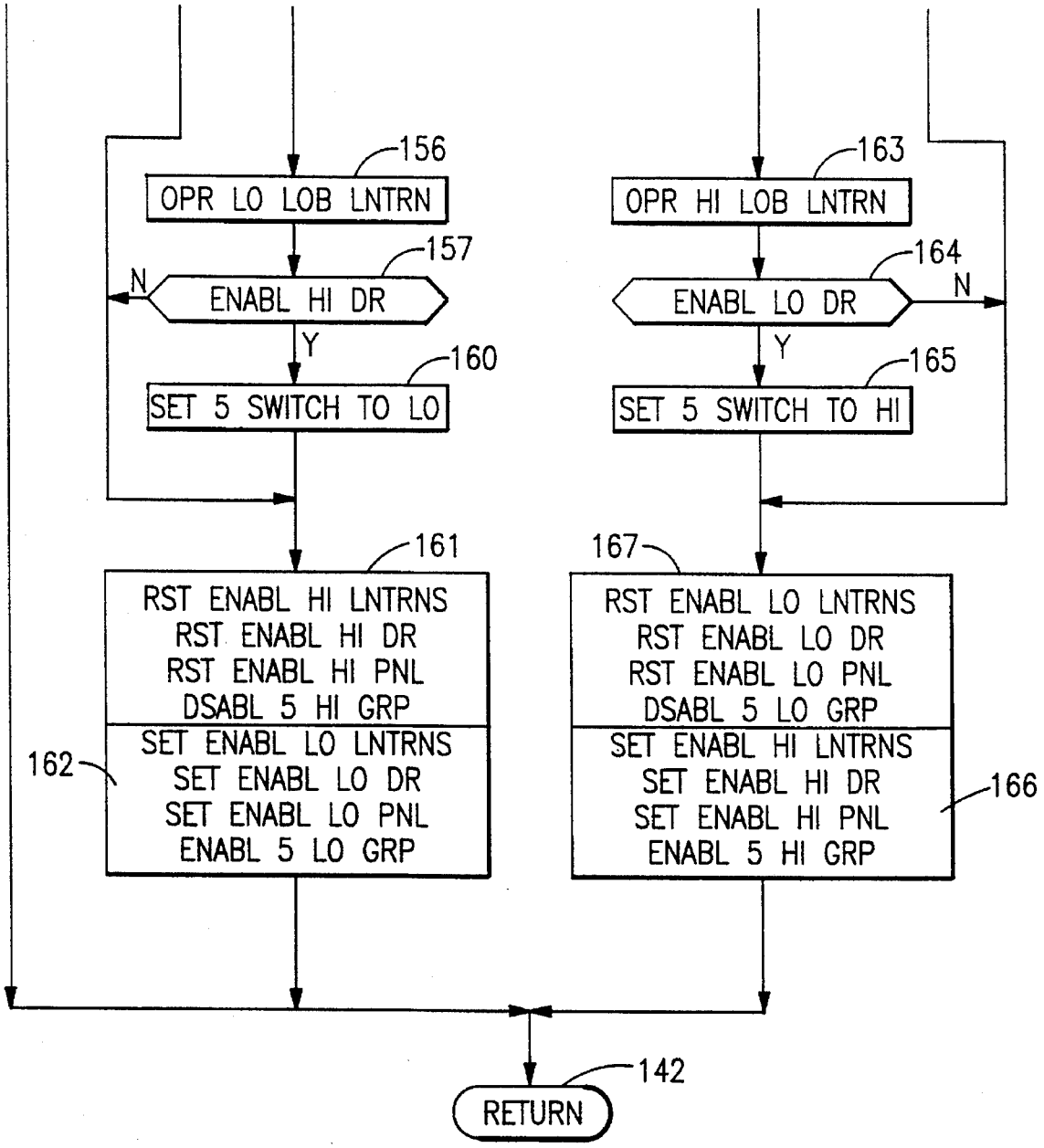
Figure 2:
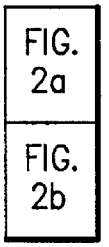

The "next equal low" flag (whether set or reset) is utilized in software modules for all swing cars (such as cars four, five and six, in the FIG. 7 version of FIG. 1 of the parent) each of which can be assigned to either the low group or the high group; the software module is described for car five with respect to FIG. 2 herein. The principal function is simply to determine which hall lanterns to operate and enable, which car panel to enable (to allow car calls), which doors to enable, and to which group the car should be assigned.

In FIG. 2, the car five swing software module is reached through an entry point 140 and a first test 141 determines if car five is out of service, or not. If it is, other programming is reverted to through a return point 142, without performing any of the swing car assignment functions. In the usual case, car five will be in service and a negative result of test 141 will reach a test 143 to see if car five has a new assignment. In this embodiment, new assignment means it has been assigned at the conclusion of a run, by other than the elevator management system or lobby dispatcher. When the doors close for the car to leave the lobby, the status of new assignment ends. This simply prevents any change in assignment after the lantern has been operated, thereby drawing the passengers of the assigned rise toward the elevator. Thereafter, as will be described hereinafter, there is no possibility of reassigning the elevator until it again reaches the stop control point of the floor lobby when traveling in the down direction. In any event, the usual case (in many computer cycles each second) is not a new assignment, so a negative result of test 143 will reach a plurality of tests 144–147 to see if either the elevator management system or a lobby dispatcher has assigned car five relatively permanently to either the low rise group or the high rise group, in a manner described more fully hereinafter. In the usual case of swing car operation, all of the tests 144–147 will be negative reaching another series of tests (which have no counterpart in the parent, and are designated with letter suffixes of the reference numeral 148). A test **148*a* determines if car five is advancing up. As used herein, "advancing up" means having a general progress direction, rather than actual motion direction or command, which in turn is referred to as simply "up". This allows performing dispatching tasks taking into account the general, traveling direction of the elevator, even though the elevator may be stopped with its doors open to permit exchange of passengers. If the elevator is advancing up, an affirmative result of test 148***a* will reach a test 148*b* to see if the upwardly traveling swing car has the bottom floor of the high rise as its committable floor, or not. If it does, this means that the car has been assigned a hall call or has registered a car call in the high rise. This means that the car must be assured of being able to function in the high rise, and be able to conclude its tasks in a manner that allows it to be reassigned, as well. Therefore, an affirmative result of test 148*b* will reach steps 166 and 167, described hereinafter, to ensure that the car is operating as a high rise car, and not as a low rise car. This path through tests 148*a* and possibly test 148*b* may be performed many, many times (several times each second) as a car proceeds upwardly through the low rise and as it proceeds upwardly through the high rise. Therefore, the car may typically already be a high rise car, in which case performing the steps 166 and 167 is redundant, but harmless.

If the result of test 148*a* is negative, this means that car five is advancing downwardly. In such a case, it is desired to not permit the low group controller or the high group controller to cause a reversal in direction by assigning up car calls to a downwardly traveling elevator. This will ensure that the swing car will return to the lobby for normal assignments in the usual case. Therefore, a negative result of test 148*a* will reach a step 151 in which all up hall calls assigned to car five by the low group and by the high group are disabled. This may be achieved as in the relative system response method of assigning hall calls set forth in either of the aforementioned Bittar patents, simply by providing a disabling high penalty to any up hall call assignment for car five after the flag of step 151 is set. On the other hand, if an interrise call is being assigned by the interrise group of FIG. 3, such disabling is not utilized; in other words, if a car is assigned to an up hall call by the interrise group, that call will not be blocked by the flag 151. While the car is traveling upwardly, there is always a positive result of test 148*a*, so step 151 is bypassed. Then a test 152 determines if the elevator has reached the point in its travel that the next committable floor is the lobby floor. In the case of car five, when it is operating in the low rise, this would be somewhere near floor number 2; but when car five is operating in the high rise, the lobby becomes the committable floor as the elevator reaches the express zone (somewhere around the lowest floor of the high rise). During most of the passes through the car five swing routine of FIG. 2, the elevator will be at other points in the elevator shaft and a negative result of test 152 will lead to a test 148*c* which determines if the car has a committable floor in the low rise, other than the lobby floor. In this embodiment, it is assumed that a car which is traveling in the express zone (that is, advancing as an express car directly through the low rise) has a committable floor of the lobby, and therefore having the committable floor of the lobby will cause an affirmative result of test 152 and therefore cannot cause an affirmative result of test 148*c*. If the car has a committable floor other than the lobby in the low rise, an affirmative result of test 148*c* will cause the program to advance to steps 161 and 162 to ensure that the car is operating as a low rise car and not as a high rise car, in a manner to be described hereinafter. If the elevator car is advancing up in the low rise or if it is advancing down in the low rise but not committed to other than the lobby floor, negative results of tests 148*b* or 148*c* will cause the remainder of the program to be bypassed, and other programming reverted to through the return point 142. Eventually, the car, traveling down, reaches the point at which the lobby is the next committable floor, so an affirmative result of test 152 reaches a test 153 to determine if the stop control point has been reached, or not. This is the point at which, among other things, the lantern at the landing should be lit in order to inform passengers that the car is approaching. According to the invention of the parent, the last moment at which the decision can be made as to whether the car should be in the low rise or the high rise is the moment when the selected one of the lanterns has to be lit. This is because of the precept of the parent invention: that the passengers will readily approach an elevator in the lobby service corridor for the floors that they intend to reach when a lantern lights (usually with a gong). Thus, if the car is going to be assigned in its next run to the low rise group, a lantern in the low rise lobby corridor 13 should be operated; then, the doors should open so as to permit entrance of passengers from the low rise lobby corridor 13. 0n the other hand, if car five is to be assigned to the high rise group in its next run, the lantern in the high rise lobby corridor 14 should be operated; then the doors should open to permit access by passengers which are in the high rise lobby corridor 14. Thus, reaching the stop control point for the lobby floor (affirmative result of both tests 152 and 153) is where normal swing car assignment takes place, and the appropriate lantern is operated in the system of the aforementioned parent.

In a step 154 a new assignment flag for car five is set to indicate that no reassignment should occur until this flag is reset, as alluded to above and described more fully hereinafter. Then a test 155 examines the "next equals low" flag which was either set or reset the last time that the building low/high software module (FIG. 11 of parent) was run. If the flag is set, indicating that the next assignment of the swing car should be to the low group, then there will be an affirmative result of the test 155 which will reach a step 156 which will operate the car five low rise lobby lantern, in the low rise lobby corridor 13, thereby announcing to passengers that this is a car which can serve their needs in the low rise of the building. Then a test 157 determines if the high doors are enabled; this is just a convenient test for whether car five was operating in the high rise during the current run; other factors could be examined as well. If car five was in the high rise in the current run, then its present assignment to the low rise for the next run is a switch, so an affirmative result of test 157 will reach a step 160 which sets the "five switch to low" flag (that is tested in test 125 of FIG. 11 of the parent in the event that biasing is to be performed to adjust for switching from one rise to the other).

Then in a series of steps 161, all the attributes of the car relating to the high rise are reset. Specifically, the enablement of all of the lanterns for car five on high rise floors is reset, the enablement of the doors on the high rise side of , the swing car 16 elevator shaft is reset, the portion of the car call panel having call buttons for high rise floors is no longer enabled, and car five is taken out of the high rise group, which can be achieved by setting to zero the car five bit in a map of available cars in the high group. Then, a series of steps 162 perform the converse functions to establish operation of car five in the low rise group. Specifically, enabling all of the lanterns for car five on the low rise floors, enabling the doors for operation at successive floors on the low rise side of the swing car 16 hoistway, enabling the car call panel for calls to the low rise floors, and enabling car five in the low rise group.

If, instead, the "next equals low" flag had been reset (in FIG. 11 of the parent), then a series of steps and tests 163–166 provides the same functions for the high rise as are provided for the low rise in the steps and tests 156–160, 162 and similar functions with respect to the low rise in steps 167 as are provided for the high rise in the steps 161.

In the event that one of the tests 144, 146 indicate that car five is relatively permanently assigned to the low rise group (such as to force an assignment during peak traffic), then an affirmative result of one of these tests will reach tests 170, 171 to operate the low rise lobby lantern in step 172. Thereafter, the steps 161 and 162 are provided in the same fashion as when car five is operating as a swing car; when this is repetitively provided, it becomes redundant resetting and redundant setting, which is irrelevant.

In the event that either the elevator management system or a lobby dispatcher has relatively permanently assigned car five to the high rise group, then an affirmative result of either test 145 or 147 will reach tests and steps 173–175 which perform operation of the high rise lantern 57 in the same fashion as tests and steps 170–172 for the low rise lantern, and then perform steps 166 and 167.

Figure 3:
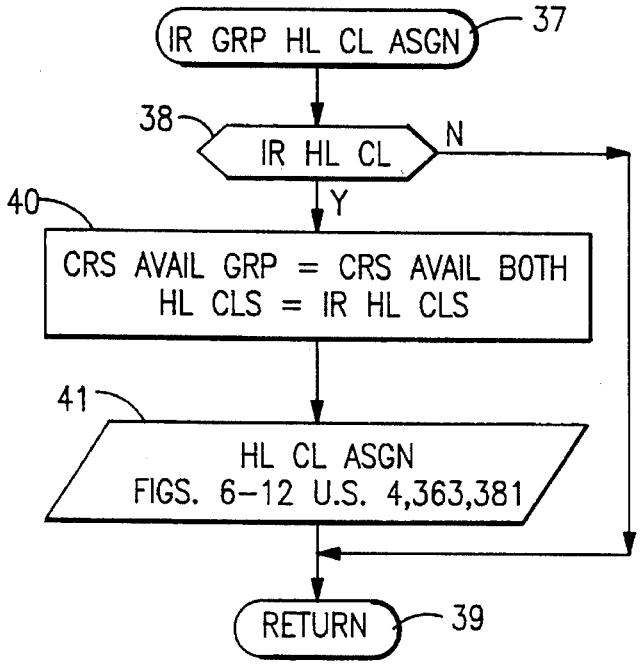
FIG. 3 is a logic flow diagram of an exemplary routine for assigning interrise hall calls to available swing cars in a first embodiment.

As a car is assigned at the conclusion of a run from one group to the other at the last moment, the step 154 will set the new assignment flag for car five. The test 143 at the top of FIG. 2 senses that fact and prevents any further assignment of the car until it later returns in the downward direction, having made a run in the assigned group. During the period of time between when the lantern is lit in the lobby corridor of one rise or the other and when the doors close in anticipation of leaving the lobby level in an upward direction, no swing car assignment can be made because an affirmative result of test 143 prevents reaching the assignment process in the remainder of FIG. 2. Instead, a test 180 determines if the car is set for operation in the up direction or not. Initially it is not, so the entire remainder of the flow chart of FIG. 3 is bypassed to the return point 142. Eventually, the direction will be switched to the up direction so that in a subsequent pass through the subroutine of FIG. 2, an affirmative result of the test 180 will reach a test 181 to determine if the doors are closed. For a few passes, the result of test 181 will be negative and the remainder of FIG. 2 is bypassed to the return point 142. Eventually, the doors are closed as the upward run in the recent assignment begins. This reaches a set of steps 182*a* where the "five new assignment" flag of step 154 is reset and the fact that the elevator has recently been switched from one rise to the other is reset. This point is chosen to eliminate further biasing (should any be occurring) since the car is fully in service with respect to its new assignment. On the other hand, the resetting of these bias flags could be achieved at some other point, if desirable, as is apparent in said parent. Since the "five new assignment" flag indicates that the swing car has been assigned to one rise or the other based on traffic burden (rather than by the EMS or dispatcher), it may be useable herein in both groups, in accordance with the invention of the aforementioned contemporaneous application. Therefore, the last one of the steps 182*a* sets a flag indicating that car five is available to both groups.

In the light of the foregoing teachings, it should be apparent that relatively straight-forward choices are to be made depending upon the rise in which the elevator is to be operated. Specifically, doors, panels, lanterns and group control have to be selected. Otherwise, operation of the elevator in the parent is the same as it normally would be, with or without all the fancy accouterments of any sort of dispatching to answer calls, up peak/down peak, zoning, channeling, and the like, as in the aforementioned patents.

Figure 5:
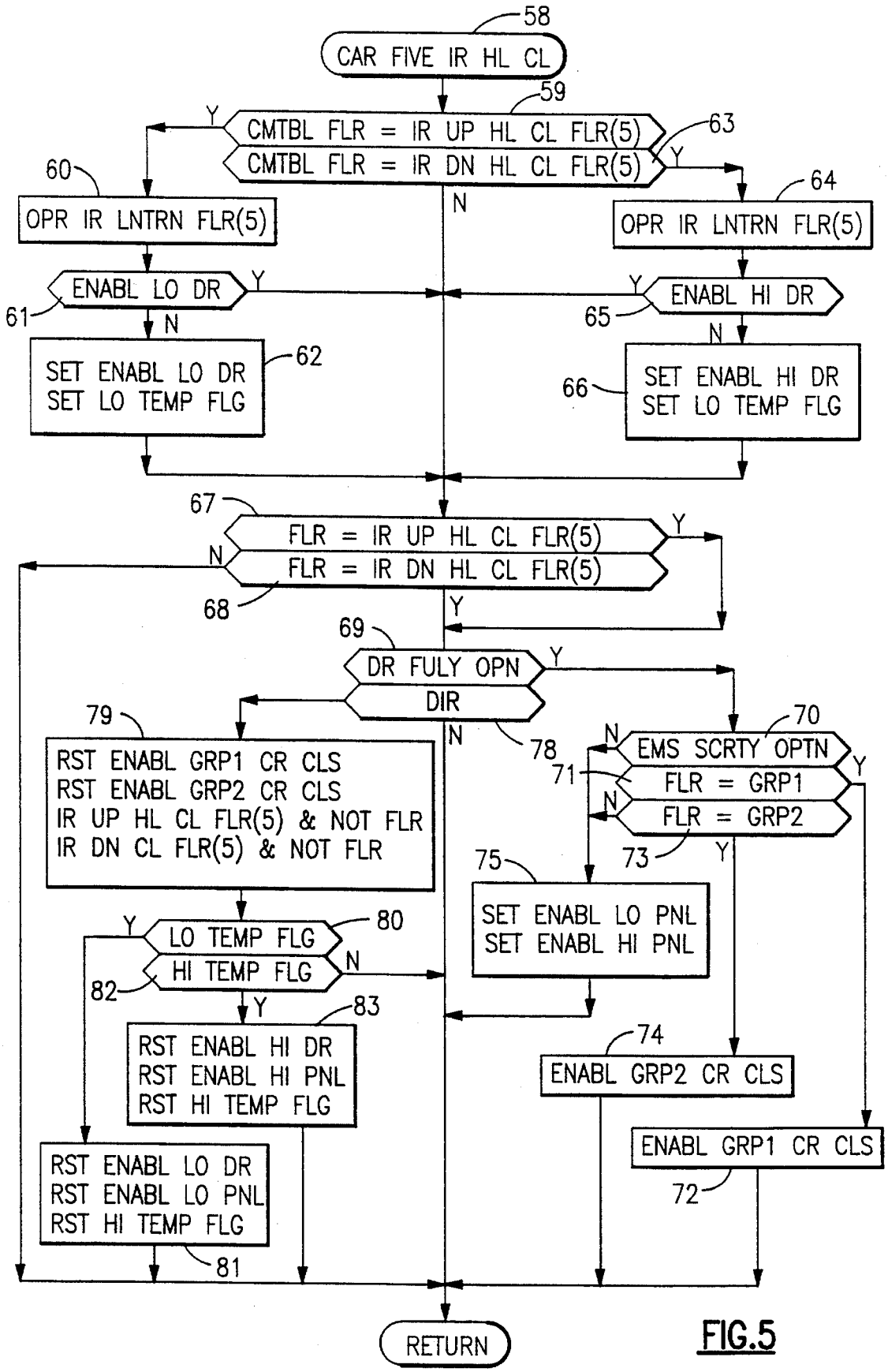
FIG. 5 is a logic flow diagram of an exemplary routine for selectively controlling the permitted access and car calls in response to an interrise hall call.

FIGS. 5, 6 and 7 of the aforementioned contemporaneous application illustrate how up traveling cars assigned to the low rise group may nonetheless accept calls into the high rise and how cars in the high rise may pick up passengers in the low rise if traffic characteristics are suitable.

Another aspect of the present invention is that cars can be assigned to an interrise group that would permit passengers in the low rise to register hall calls known to be for travel to floors in the high rise, and vice versa, simultaneously with assignment to other groups, which is the subject matter of the aforementioned contemporaneously filed U.S. patent application. The embodiment of this invention shown in FIG. 3 is within a system for multi-group control of swing cars. Regardless of traffic demand, it is possible to permit any swing car to accept an interrise hall call, which is designated as such by being on a special riser (a special hall call button), that may be accessed only in response to some form of key, or not, as the case may be. In FIG. 3, an interrise group hall call assignment is reached through a transfer point 37 and a first test 38 determines whether there is an interrise hall call that has not yet been assigned. If not, other parts of the program are reverted to through a return point 39. If there is an interrise hall call which has not yet been responded to by a car, the routine will reach a step 40 in which the map of cars available to the group (in this case the interrise group) is set equal to the cars available to both groups (that is all of the swing cars which have set their "available to both" flags (in the step 182*a* of FIG. 2). And, the hall calls for the group are taken to be equal to all the hall calls requesting interrise service. Then, the hall call assignment routines 41 illustrated in FIGS. 6–12 of the aforementioned '381 patent, or any other suitable hall call assignment routine, may be provided. In case a car is assigned to a hall call, it may or may not answer that call since this routine can be performed repetitively until answered, as is described in the '381 patent. When there is a call assigned, it may be in the same rise as the group which is currently controlling the car, or not. For instance, if a car which is traveling upwardly and answering calls in the low rise group is in fact the quickest or best car to reach an interrise call in the high rise, it may be assigned to the call in the high rise while it is still being controlled by the low rise group. Similarly, a car being controlled by the high rise group may be assigned to an interrise call in the low rise when it appears that it is the best candidate to respond to that call. The determination of the best candidate may be in accordance with the relative system response methodology described in the '381 patent, or in accordance with some other suitable call assignment scheme. In the case of interrise traffic, the relative level of traffic in either rise is ignored so as to ensure that what appears to be a relatively good assignment can be made to any of the swing cars which are available to both groups.

The embodiment described with respect to FIGS. 2 and 3, which may be incorporated in the system of the aforementioned contemporaneous application, utilizes the multi-group feature and the ability to enable the high rise elevator car functions and disable the low rise functions, if the car is picking up an interrise passenger in the low rise for delivery into the high rise; similarly, for high rise passengers who are heading for the low rise.

If desired, the assignment of cars available to the interrise group in steps 40 could be inclusive of all swing cars which are in service, even though those cars might be otherwise dedicated by the elevator management system or by the lobby dispatcher (as described in FIG. 2). These variations are irrelevant to the present invention.

Figure 4:
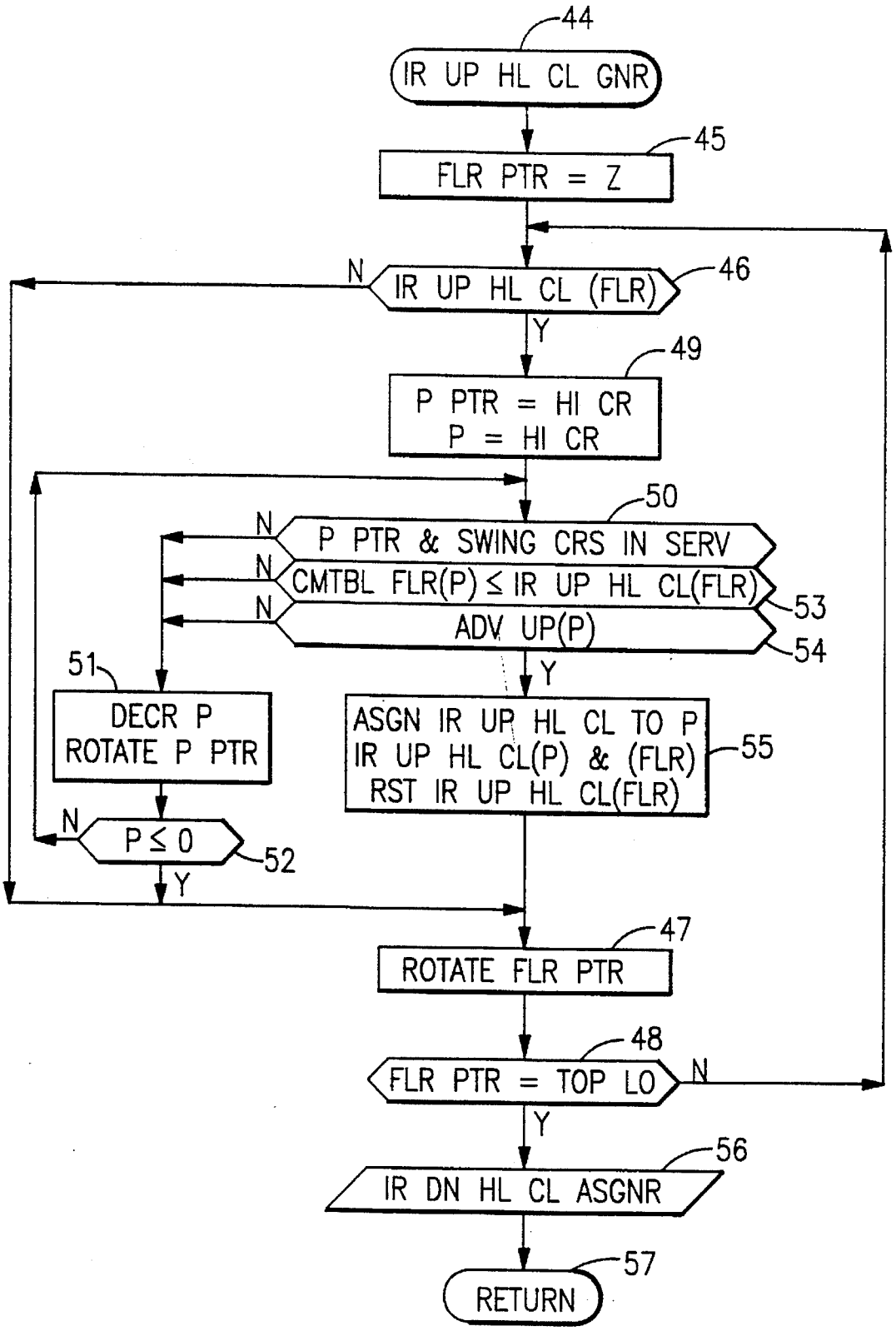
FIG. 4 is a logic flow diagram of an exemplary routine for assigning interrise hall calls to available swing cars in a second embodiment.

Another embodiment of the invention assigns interrise calls to any available swing car that is approaching the call, allowing the swing car to change into the destination group, if necessary. Referring now to FIG. 4, an interrise up hall call assigner routine, for assigning up hall calls to swing cars, is reached through a transfer point 44, and a first step 45 sets a floor pointer (which keeps track of floors during the process of checking for and assigning interrise calls) to the second floor of the building (since lobby calls are not interrise calls by definition). Then, a test 46 determines if there is an interrise up (IR UP) hall call registered for the floor identified by the floor pointer (initially, floor two). If there is no call, a negative result of test 46 reaches a step 47 to rotate the floor pointer to the next floor (floor three in this case), and then a test 48 determines if the floor pointer is pointing to the top floor of the low rise, or not. Initially, it will not be so a negative result of test 48 reverts the routine to the test 46 to see if there is an IR UP hall call on the third floor. This process repeats until all the floors in the low rise have been tested, or until a floor is reached in the process which has an interrise up hall call. In that case, an affirmative result of test 46 reaches a pair of steps 49 in which a P pointer and a P counter are both set to the high car of all the cars in the high group. This may include cars which are not swing cars; however, those cars are eliminated in a test 50, a negative result of which reaches a pair of steps 51 in which the P counter and P pointer are both decremented to the next lower numbered car in the group. Then a test 52 determines if all the cars in the group have been examined or not. If not, a negative result of test 57 reverts the routine to the test 50 to see if the car presently under consideration is a swing car in service. If it is, then a test 53 determines if the call is ahead of the car or not. It is quite likely that the interrise up hall calls will be assigned to cars which have just been assigned to the low rise or the high rise and are standing at the lobby waiting for demand or for time out before closing the doors and advancing upwardly in the building. Cars assigned to either rise and traveling upward toward the high rise are able to accept interrise up hall calls registered in the low rise for travel into the high rise. If the call is not still ahead of the car (the call is behind the car) a negative result of test 53 eliminates that car from consideration and the steps 51 and test 52 cause the next car in sequence to be considered. If a car can be found for which the interrise up hall call is ahead of the car, an affirmative result of test 53 will reach a test 54 to see if the car is traveling up. If not, there is no point in assigning the up call to it. But if so, the routine reaches a series of steps 55 in which the interrise up hall call is assigned to car P, a map identifying an interrise up hall call floor for car P is set equal to the floor under consideration (which is used as described with respect to FIG. 5 hereinafter) and the interrise up hall call for the floor which has just been assigned is reset. If none of the swing cars are traveling up ahead of the interrise up hall call floor, successive negative results of the tests 53 and 54 will cause decrementing the P counter and rotating the P pointer in steps 51 until all of the cars have been tested. In that case, test 52 will be negative reaching the step 47 to rotate the floor pointer to the next floor in turn, and the test 48 determines if all of the floors in the low rise have been tested for hall calls. Generally they will not have been, so a negative result of test 48 will revert the program to the test 46 to see if there is an interrise up hall call on the next succeeding floor.

In FIG. 4, it is possible that an interrise up hall call on some floor (such as the third or fourth floor) might be behind any swing car, thereby failing to assign that call to any of the cars in the group. However, there may be an interrise up hall call further up in the building (such as on the 13th floor) which is ahead of one of the swing cars in the high group. For that reason, the failure to assign one call to a swing car does not preclude attempting to assign other calls to that car. This embodiment assumes there will always be one swing car available to handle interrise hall calls.

Eventually, all of the floors in the low rise will be tested for interrise up hall calls which will be assigned to swing cars where possible. This will cause an affirmative result of the test 48 to reach an interrise down hall call assignor routine 56 to perform similar functions for interrise down hall calls, which is achieved by testing the lowest floors in the high rise to the highest floors in the high rise, and attempting to assign any interrise hall calls within the high rise to a downward traveling car which is ahead of the call. This will not occur with cars that are performing normal functions in the low rise, since such cars will not be above any floor in the high rise. In the routine 56, a test similar to test 46 determines if there is an interrise down hall call for the floor in question; the steps 49 and test 50 are identical; tests like tests 53 and 54 determine if the car in question is traveling down ahead of the call; and the steps similar to steps 55 assign an interrise down hall call to the car in question, set the interrise down hall call floor for car P equal to the floor under consideration, and rest the interrise down hall call which has just been assigned. For any call, anywhere, in either direction, the swing car will eventually be approaching the call in the same direction as the call, and be assigned thereto. When interrise up hall calls and down calls have been assigned insofar as possible, following the routine 56, other parts of the program are reverted to through a return point 57. In FIG. 4, the floors may be tested from high to low, the cars may be tested from low number to high number, down calls may be treated before up calls, and other changes may be made.

Referring now to FIG. 5, a car five interrise hall call subroutine is reached through a transfer point 58 and a first test 59 determines if the committable floor of car five is equal to the interrise up hall call floor (if any) of car five which may (or may not) have been set in the steps 55 of FIG. 4. If it is, then a step 60 operates a special, interrise lantern on the floor where car five is, and a test 61 determines if car five is enabled in the low rise. If not, the low rise door is enabled in a series of steps 60 so as to permit receiving a passenger at the low rise floor where the interrise up hall call is being answered, and, a "low temporary" flag is set. If the car is enabled in the low rise, test 61 bypasses the steps 62. On the other hand, if the committable floor is not an interrise up hall call floor for car five, then a negative result of test 59 reaches a test 63 to determine if the current committable floor for the elevator is an interrise down hall call floor for car five. If it is, a step 64 operates the interrise lantern on that floor and a test 65 will cause a series of steps 66 to enable the high rise doors for car five, so as to enable car five to receive a passenger at the floor of the interrise down hall call, and a "high temporary" flag, unless car five is enabled in the high rise. Then a pair of tests 67, 68 determine if the current floor of car five is either an interrise up hall all floor or an interrise down hall call floor for car five. If it is either, then a test 69 determines if the door of the elevator is fully open or not. Initially, as the car approaches the interrise call floor and the doors finish opening after the car reaches a complete stop, one of the tests 67, 68 will be positive while test 69 is positive. This will reach a test 70 to determine if the elevator management system has set a security option, or not. If the security option has been set, a test 71 determines if the current floor of the elevator is a "security group one" floor or not. If it is, an affirmative result of test 71 will reach a step 72 to enable group one car calls; this permits any passenger entering on the security floor to register car calls to any other floor related in the group one security plan to the current floor. If test 71 is negative, a test 73 determines if the floor is in a second group of security floors, thereby to enable registering car calls to floors related thereto by means of a step 74. The feature of security described with respect to tests and steps 70–74 is an option which need not be used if not desired. If it is not, or if this floor is not in Group 1 or Group 2, a negative result of tests 70, 71, 73 reaches steps 75 to enable both the high and low rise car call button panels; only one needs to be enabled; enabling the other is redundant, but harmless. Instead of an EMS option, step 70 could test the fact that a special key card was used to make the IR hall call or to enter a car call.

When test 69 is negative, the elevator door is closed or closing, and if the car has been commanded to move, it will have direction so that a test 78 will be affirmative, reaching a series of steps 79 which will reset the enablement of the security group car call buttons and will remove this floor from the maps of interrise up and down hall call floors for car five by ANDing the complement of the current floor map to the maps of interrise up and down hall calls for floor five. Then a test 80 determines if the low temporary flag had been set in the steps 62, and if so, the low doors, panel and temporary flag are reset in a series of steps 81. Otherwise, a test 82 may reach steps 83 to reset the high lanterns, doors, panel and temporary flag. All of the steps and tests 80–83 need not be used—and are likely to not be used in many embodiments. Then, other parts of the program are reached through a return point 84. Notice that the map of interrise up hall call floors and the map of interrise down hall call floors, for any car, may contain more than one floor if more than one interrise up call or down call had been assigned to the car at one time.

If, in any given utilization of the present invention, the interrise calls are not to be given precedence over the semi-permanent assignment of a swing car to one rise or the other by the EMS or the dispatcher, then the test 50 of FIG. 4 can be limited to cars "available to both". In that case, the interrise calls will only take precedence over traffic burden assignment in the test 155. The embodiment of FIG. 3 can take precedence over EMS and dispatcher assignments by having cars available to the interrise group equal all swing cars in service, in steps 40. The embodiment of FIG. 3 implies use of a complex assignor routine to make the best assignment (and repetitive reassignment, until answered) to the call. The embodiment of FIG. 4 is simple, and just uses the first suited car. The embodiments of FIGS. 3 and 4 require group changeover function capability of the type described with respect to tests **148*b* and 148*c*, FIG. 2, hereinbefore. On the other hand, the changeover function capability is not essential to the present invention. Another embodiment of the invention assigns the interrise hall call to a car which is enabled in the rise of the destination floor: that is, if an interrise hall call is registered in the low rise, its destination rise is the high rise, and the call will be limited in its assignment to cars in the high rise. This is achieved for interrise up hall calls in FIG. 4 simply by limiting test 50 therein to swing cars assigned to the high group. Similarly, for the interrise down hall call assignor (not shown, but equivalent to FIG. 4). In such a case, assignment will take place until there is a car assigned to the high rise. If desired, a negative result of test 46 or an affirmative result of test 52, before reaching step 47 could set an "interrise next equals high" flag which could be used in FIG. 2 ahead of step 155** to force the high rise car. Similarly, for high rise down calls which could force a low rise car assignment. The interrise hall call handling of the present invention can be adapted to literally any sort of swing car system having the capability of serving both the low rise and the high rise in a single car.

It should be borne in mind that the controller in a building in which the present invention is implemented may comprise a single controller (including the high, low and IR group controls) which in turn may comprise a single signal processor distributed signal processors, or there may be distinct subcontrollers, one for the overall building functions, one for the high group burden and call assignment, one for the low group burden and for the call assignment, one for each car for the swing control, and so forth.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A multi-elevator system, comprising:

a plurality of elevators arranged to service at least a low rise group of floors and a high rise group of floors, responding to up hall calls and down hall calls assigned thereto, respectively, by a low group control and a high group control, all of said elevators having service corridors on the same lobby floor for access to the relevant floors;

at least one of said elevators comprising a swing car disposed within a hoistway having access to both of said groups of floors, having first doors, hall lanterns and car call buttons for servicing said low rise group of floors and having second doors, hall lanterns and car call buttons for servicing said high rise group of floors; and a controller for providing a swing car assignment signal indicative of the selected group of floors to which the next swing car assignment should be made and in response thereto operating the lobby hall lantern and enabling the remaining hall lanterns, doors and car call buttons of the selected group of floors, enabling response of said swing car to hall calls in said selected group of floors assigned thereto by the corresponding group control identified by said swing car assignment signal, and disabling response of said car to hall calls in the other of said group of floors, and dispatching said swing car for service to said selected group of floors;

characterized by the improvement comprising:

a hall call button in a first one of said groups of floors for registering an interrise hall call for service into a second one of said group of floors and providing an interrise hall call signal in response thereto, said controller, in response to said interrise hall call signal, enabling said swing car to service said interrise hall call.

2. A system according to claim 1 further characterized by:

said system comprising a third group control for assigning interrise hall calls in said system; and said controller enabling response of said swing car to hall calls assigned thereto by said third group control in response to said interrise hall call.

3. A system according to claim 1 further characterized by:

said controller, in response to said interrise hall call signal, when said swing car is traveling toward said interrise hall call signal in the same direction as said interrise hall call signal, assigning said swing car to service said interrise hall call.

4. A system according to claim 1 further characterized by:

said controller, in response to said swing car arriving at the floor of said interrise hall call, in response to said interrise hall call, operating an interrise lantern on said floor.

5. A system according to claim 1 further characterized by:

said controller, in response to said swing car approaching the floor of said interrise hall call, in response to said interrise hall call, enabling the doors of said swing car for the one of said group of floors in which said hall call is registered.

6. A system according to claim 1 further characterized by:

said controller, in response to said swing car approaching the floor of said interrise hall call, in response to said interrise hall call, determining whether said swing car is enabled in the one of said groups of floors in which said interrise hall call is registered, and if not, enabling the doors for said group of floors.

7. A system according to claim 1 further characterized by:

said controller, in response to said swing car arriving at the floor of said interrise hall call, in response to said interrise hall call, enabling at least one car call button on the panel of said swing car to register a call into the second one of said groups.

8. A system according to claim 7 further characterized by:

said one car call button comprising a floor associated with the floor of said interrise hall call in a security plan.

9. A system according to claim 7 further characterized by:

said call button comprising a button in the array of hall call buttons related to the group of said floor including the destination of said interrise hall call.

10. A system according to claim 9 further characterized by said controller, in response to said swing car approaching the floor of said interrise hall call, in response to said interrise hall call, determining whether said swing car is enabled for operation in the one of said groups of floors in which said interrise hall call is registered, and if not, setting a temporary flag, said controller, in response to said swing car departing from said floor of the interrise hall call in the presence of said temporary flag, resetting enablement of said car call button.

11. A system according to claim 7 further characterized by:

said controller, in response to said swing car, departing from the floor of said interrise hall call, resetting the enablement of said hall call button.

12. A multi-elevator system, comprising:

a plurality of elevators arranged to service at least a low rise group of floors and a high rise group of floors, responding to up hall calls and down hall calls assigned thereto, respectively, by a low group control and a high group control, all of said elevators having service corridors on the same lobby floor for access to the relevant floors;

at least one of said elevators comprising a swing car disposed within a hoistway having access to both of said groups of floors, having first doors, hall lanterns and car call buttons for servicing said low rise group of floors and having second doors, hall lanterns and car call buttons for servicing said high rise group of floors; and a controller for providing a swing car assignment signal indicative of the selected group of floors to which the next swing car assignment should be made and in response thereto operating the lobby hall lantern and enabling the remaining hall lanterns, doors and car call buttons of the selected group of floors, enabling response of said swing car to hall calls in said selected group of floors assigned thereto by the corresponding group control identified by said swing car assignment signal, and dispatching said swing car for service to said selected group of floors;

characterized by the improvement comprising:

a hall call button in a first one of said groups of floors for registering an interrise hall call for service into a second one of said group of floors and providing a special traffic signal in response thereto;

said system comprising a third group control for assigning hall calls in said system; and said controller enabling response of said swing car to hall calls assigned thereto by said third group controller in response to said special traffic signal.

13. A system according to claim 12 further characterized by:

said first rise is said low rise and said second rise is said high rise.

14. A system according to claim 12 further characterized by:

said first rise is said high rise and said second rise is said low rise.

15. A system according to claim 12 further characterized by:

said controller enabling passengers in said swing car to register a car call for said service into said other group of floors when said swing car is at the floor of said hall call button.

* * * * *